United States Patent [19]

Lambke

[11] Patent Number: 4,751,351

[45] Date of Patent: Jun. 14, 1988

[54] SWITCH ASSEMBLY PROVIDING TACTILE FEEL

[75] Inventor: David G. Lambke, Bloomingdale, Ill.

[73] Assignee: Eaton Corporation, Cleveland, Ohio

[21] Appl. No.: 48,279

[22] Filed: May 11, 1987

[51] Int. Cl.[4] ..... H01H 13/48

[52] U.S. Cl. ..... 200/67 D; 200/340; 251/75

[58] Field of Search ..... 200/67 D, 340, 76; 137/529, 540; 251/75, 322, 337

[56] References Cited

U.S. PATENT DOCUMENTS 2,967,922 1/1961 Dressel ..... 200/340
3,264,884 8/1966 Brooker ..... 200/76
4,112,273 9/1978 Arakelian et al. ..... 200/67 D
4,488,020 12/1984 Zalewski et al. ..... 200/67 D
4,579,141 4/1986 Arff ..... 251/75

*Primary Examiner*—Renee S. Luebke
*Attorney, Agent, or Firm*—A. E. Chrow

[57] ABSTRACT

A switch biasing member (20) is provided that features substantially transverse apposed resilient arm pairs ($A_1$, $A_2$) and ($B_1$, $B_2$) that extend from a support member (5) to respective preferably arcuately shaped spaced-apart free-ends (14, 14') and (16, 16') that are operative to engage an actuator (2) and impose respective forces ($F_1$) and $F_2$) that respectively increasingly and then decreasingly appose movement of actuator (2) axialy between two positions such that the combination of forces ($F_1$) and $F_2$) provide a tactile feel to operation of actuator (2).

10 Claims, 3 Drawing Sheets

SWITCH ASSEMBLY PROVIDING TACTILE FEEL

INTRODUCTION

This invention relates generally to a biasing member that provides movement of a switch actuator with a tactile feel and more particularly to a biasing member that is operative to provide first and second biasing forces that respectively initially increasingly and thence decreasingly appose movement of a switch actuator between first and second positions such that the combination thereof is operative to provide a tactile feel in moving the actuator therebetween.

BACKGROUND OF THE INVENTION

A variety of methods have been used in the past to provide movement of a switch actuator such as a button or the like with a tactile feel. A tactile feel has historically been provided by engaging the actuator with a biasing member that imparts a singular biasing force against the actuator that is operative to first increasingly resist and then decreasingly resist movement of the actuator between two positions such as in commonly known snap action type switches.

Examples of a single pair of apposed spring leaves that first resist and then snap to provide a singular biasing force tnat assists in moving an electrical switch between two positions are respectively disclosed in U.S. Pat. Nos. 3,566,057; 3,983,351; and 3,999,025, the disclosures of which are incorporated herein by reference. An example of a double throw type snap action switch that utilizes a dome shaped biasing member to provide a singular biasing force that by reversing direction first resists and then snaps to assist movement of the switch is disclosed in U.S. Pat. Nos. 4,438,304, the disclosure of which is incorporated herein by reference.

As previously described, prior-art biasing members have been limited to providing a singular snap action for imparting a tactile feel to the operation of a switch or the like that is generally coarse in nature.

In contrast to the above, the biasing member of the present invention is operative to provide a more subtle and tactile feel in moving an actuator between two positions by imparting a combination of two biasing forces against the actuator respectively initially increasingly and thence decreasingly apposing movement of the actuator between two positions to provide a tactile feel to its operation.

SUMMARY OF THE INVENTION

Accordingly, it is an object of this invention to provide a biasing member operative to impart a tactile feel to operation of a switch actuator.

It is another object of this invention to provide a biasing member that provides a combination of two biasing forces for providing a switch actuator with a tactile feel during its operation.

It is still another object of this invention to provide a switch operated by an actuator whose operation is provided with a tactile feel by reason of a biasing member engaged therewith that is operative to impart a combination of two biasing forces thereagainst that respectively initially increasingly and thence decreasingly appose movement of the actuator in a manner providing a tactile feel to its operation.

DESCRIPTION OF SOME PREFERRED EMBODIMENTS

A preferred embodiment of a biasing member 20 made in accordance with the invention is shown in FIGS. 1–4. Biasing member 20 is preferably a one-piece construction stamped from a resilient material having a thickness suitable for the application involved that is preferably the same for the support portion and cantilever arm pairs hereinafter described with respect to FIG. 2. Biasing member 20 preferably has a rectangular support portion 5 from which respectively extend apposed arm pairs $A_1$, $A_2$ and apposed second cantilever arm pairs $B_1$, $B_2$.

Figure 1:
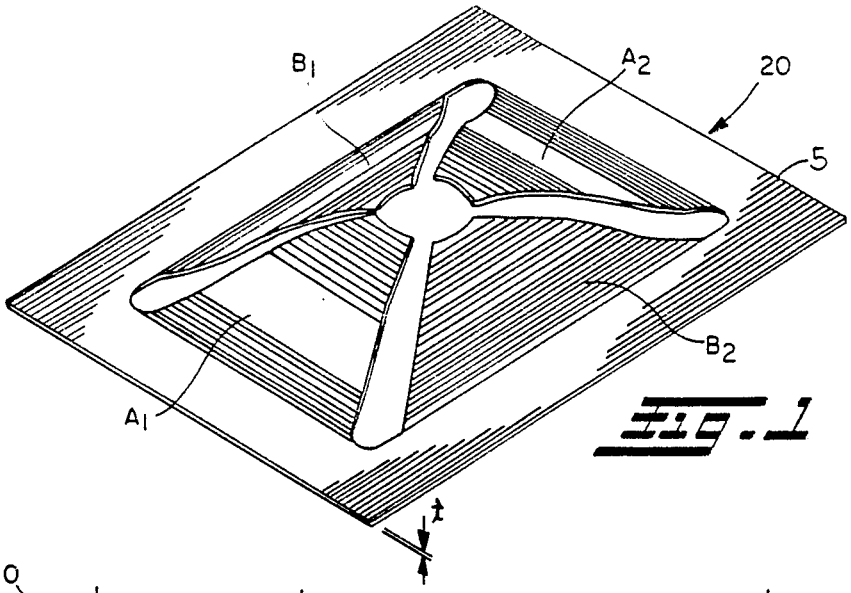
FIG. 1 is a perspective view of a preferred embodiment of the biasing member of the invention.
Figure 2:
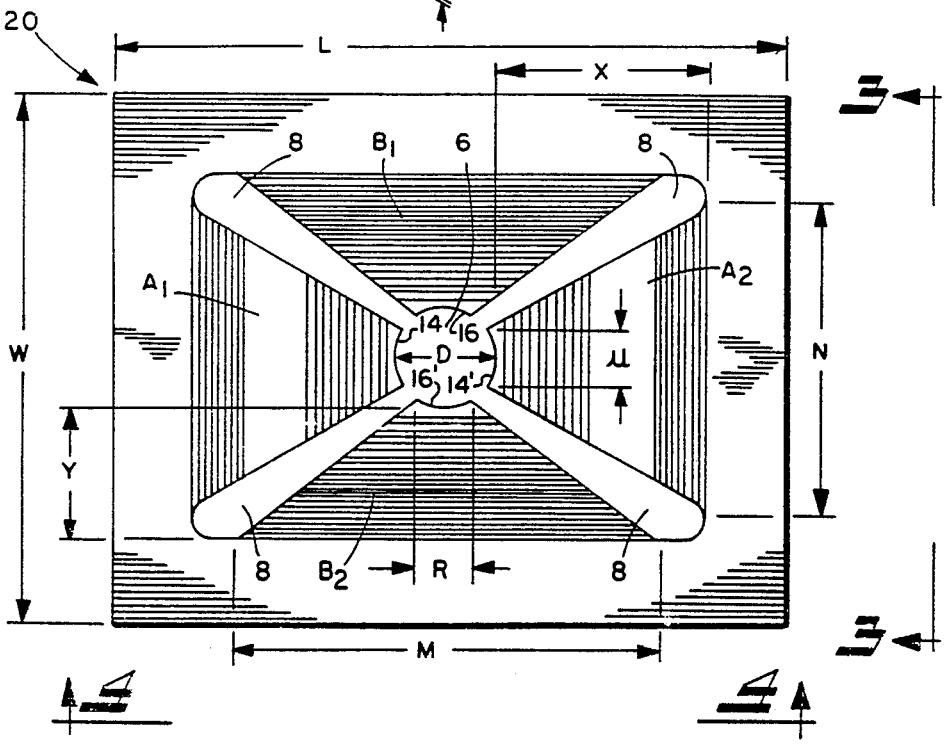
FIGS. 2, 3 and 4 are respectively top, right side and front side elevation views of the biasing member of FIG. 1.

As shown in FIG. 2, support portion 5 has a length L and a width "W". Cantilever arms $A_1$ and $A_2$ extend towards each other from opposite sides of portion 5 to apposed spaced-apart free-ends 14 and 14' in overhanging relationship to portion 5. Cantilever arms $B_1$ and $B_2$ are substantially transverse to arms $A_1$ and $A_2$ and extend from opposite sides of support portion 5 to apposed spaced-apart free-ends 16 and 16' in overhanging relationship to portion 5.

Support portion 5 is preferably substantially flat with free-ends 14, 14', 16 and 16' preferably laying in a plane that is substantially parallel to support portion 5. Free ends 14, 14', 16 and 16' are spaced-apart and preferably arcuately shaped to provide a substantially circular segmented opening 6 therebetween having a diameter D. The curvilinear length of free-ends 14 and 14' is denoted as u and the curvilinear length of free-ends 16 and 16' is denoted as R in FIG. 2.

Arms $A_1$ and $A_2$ are essentially mirror images of each other as are arms $B_1$ and $B_2$. Arms $A_1$, $A_2$, $B_1$ and $B_2$ preferably have a triangular shape provided by the four spaced-apart slots 8 extending radially from opening 6 as shown in FIG. 2 with their respective bases adjacent support portion 5. The width of the base of arms $A_1$ and $A_2$ is denoted by N and the width of the base of arms $B_1$ and $B_2$ is denoted by M in FIG. 2.

Figure 3:
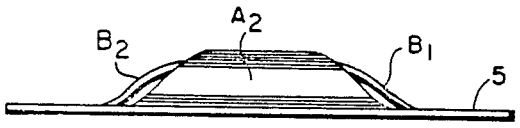
Figure 4:
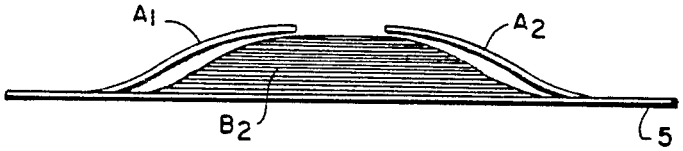

FIG. 3 shows a view 3—3 from the right side of biasing member 20 shown in FIG. 2 and FIG. 4 shows a view 4—4 from the front side of biasing member 20 of FIG. 2.

Figure 5:
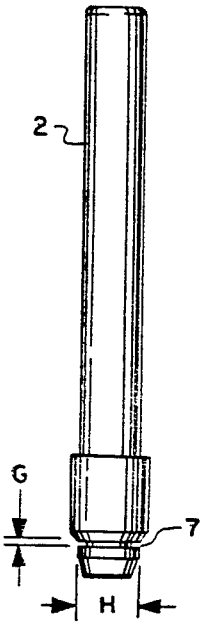
FIG. 5 is a side elevation view of an embodiment of an actuator operative for use with the biasing member of FIGS. 1–4.

FIG. 5 shows an actuator 2 that is adapted to be inserted into circular opening 6 of biasing member 20 shown in FIG. 2. Actuator 2 has a substantially cylindrical configuration having a diameter H at its lower end beneath a circumferential groove 7 having a breadth denoted as G and a diameter that is substantially the same as diameter D of opening 6.

Diameter H is sufficiently larger than diameter D of opening 6 such that when the lower end of actuator 2 is inserted through opening 6, free-ends 14, 14', 16 and 16' will spread sufficiently to enable them to engage groove 7 and secure actuator 2 to biasing member 2. The breadth G of groove 7 is preferably slightly greater than the thickness of the arm pairs such as being about 0.25 millimeter when the thickness of the arm pairs is about 0.002 inch.

Once secured to biasing member 20 in the manner described, actuator 2 is operative to move in a direction that is substantially orthogonal to the plane of support portion 5.

Figure 6:
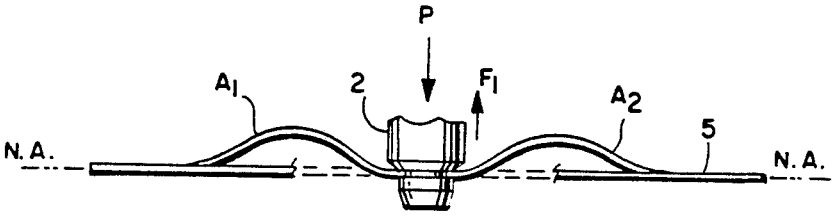
FIG. 6 is a partially schematic cross-sectional view through a first pair of resilient apposed arms of the biasing member of FIG. 1 showing the force imposed thereby upon the actuator.
Figure 7:
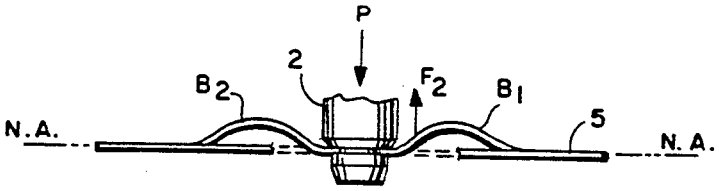
FIG. 7 is a cross-sectional view through a second pair of resilient apposed arms transverse to the first pair of FIG. 6 showing the force imposed thereby upon the actuator.

The effect of pressing actuator 2 downwardly upon arms $A_1$ and $A_2$ and upon arms $B_1$ and $B_2$ is respectively shown in FIGS. 6 and 7.

In FIGS. 6 and 7, support portion 5 is restricted against movement relative actuator 2 by securing it to a suitable fixed support. Support portion 5 has a neutral bending axis N.A. laying in a plane through support portion 5.

In FIG. 5, as actuator 2 is pressed downwardly by a force P between a first and second position, not referenced, arms $A_1$ and $A_2$ exert an upwardly directed biasing force $F_1$ that initially increases and then decreases in resisting movement of actuator 2 between the two positions.

Generally, position 1 is an initial "at rest" position and position 2 is an "actuated position" which may be either an engagement or disengagement function depending on how the actuator is being used.

In FIG. 7, pressing downwardly upon actuator causes arms $B_1$ and $B_2$ to bend downwardly and exert an upwardly directed force $F_2$ that initially increases and then decreases in resisting movement of actuator 2 between the two positions.

Neglecting the weight of actuator 2, the value of force P required to move actuator 2 downwardly is a function of the sum of forces $F_1$ and $F_2$ and is sufficiently greater than the sum to cause actuator 2 to move downwardly between the first and second positions to provide actuator 2 with a tactile feel in its operation.

Additionally, the sum of forces $F_1$ and $F_2$ is sufficient to return actuator 2 to its initial position when force P is removed. The respective values of forces $F_1$ and $F_2$ in newtons when actuator 2 is moved for about 1.3 millimeters downwardly from a first position at which no bending force is exerted upon arms $A_1$, $A_2$, $B_1$ and $B_2$ is shown in graph form in FIG. 8. The biasing member used to generate the data shown in FIG. 8 was in the form of the preferred embodiment 20 shown in FIG. 1, made from about 0.002 inch thick type 301 stainless steel having dimensions referred to in FIG. 2, shown in following Table I.

TABLE I

| Dimension | Millimeters (approximate) |
|---|---|
| L | 17 |
| W | 13 |
| D | 2.5 |
| U | 1.44 |
| R | 1.4 |
| X | 7.25 |
| Y | 5.25 |
| M | 11.00 |
| N | 8.00 |

Figure 8:
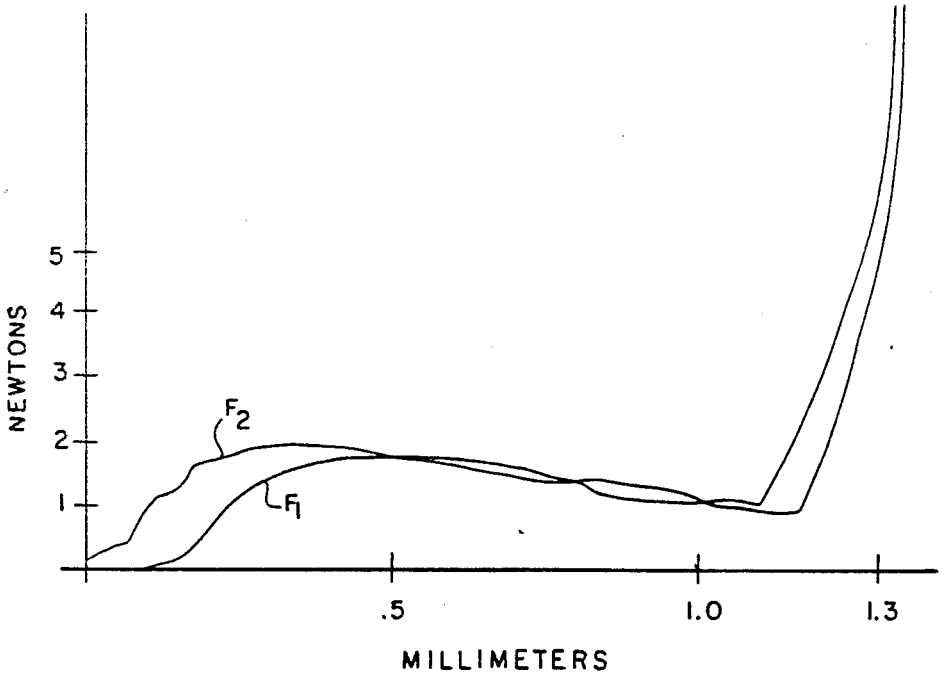
FIG. 8 is a graph of the respective biasing forces imposed upon the actuator by the biasing member of FIG. 2 as the actuator is moved between two positions.

In FIG. 8, it can clearly be seen that force $F_1$, against downward movement of actuator 2 provided by arms $A_1$ and $A_2$ and force $F_2$ against downward movement of actuator 2 provided by arms $B_1$ and $B_2$ initially increases and then decreases as actuator 2 is moved downwardly about 1 millimeter from its initial position at rest.

Figure 9:
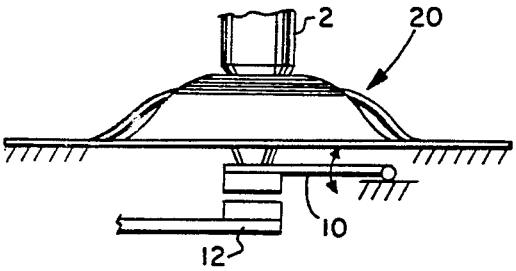
FIG. 9 is a partial side elevation view of the biasing member of FIG. 1 operative to provide a tactile feel to operation of an electrical switch.
Figure 10:
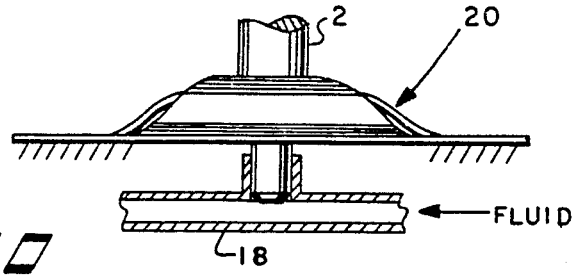
FIG. 10 is a partial side elevation view of the biasing member of FIG. 1 operative to provide a tactile feel to actuator operative to control flow of a fluid medium.

Preferably, actuator 2 is operative such that it does not bend free-ends 14, 14', 16 and 16' below neutral axis N.A. shown in FIGS. 6 and 7. FIGS. 9 and 10 show examples of applications for biasing members made in accordance with the invention. In FIG. 9, member 20 is used to provide a tactile feel to actuator 2 for operation of an electrical contact 10 that is caused to move downwardly and make electrical contact with contact 12 by downward movement of actuator 2. The biasing member of the invention may be used in any type of electrical circuitry where it is desired to make or break one or more electrical circuits by movement of an actuator. Actuator 2 may for example be made from a conductive metal such that it itself is in electrical contact in the circuit rather than causing movement of a separate electrical contact.

When made from an electrically conductive material, one or more of the arms may themselves operate to make and break one or more electrical circuits in response to movement of the actuator.

The biasing member of the invention is also suitable for use in fluid control devices for which one example is shown in FIG. 10 where member 20 is used to provide a tactile feel to movement of actuator 2 for controlling fluid flow through a fluid control device 18.

Biasing members made in accordance with the invention may be made from any suitable plastic or metal or composites thereof having the resiliency required. Although preferably having a rectangular-shaped support portion having triangularly shaped arms as herein described providing forces $F_1$ and $F_2$ that are different from each other, the biasing member support portion as well as the arms may have any shape that utilizes separate apposed arm pairs that are operative to provide a tactile feel to operation of an actuator. The support portion of the biasing member may be square with the apposed arm pairs having substantially the same cantilever length resulting in the biasing forces of both being substantially the same.

Although the free-ends of the respective arm pairs of the biasing member of the invention preferably lay in a single plane for engagement with the actuator at a single location such as a circumferential groove as herein described, the free-ends of the respective arm pairs may be offset from each other so they engage the actuator at different locations when such is desired.

Likewise, the free-ends do not have to be arcuately shaped nor the actuator cylindrically shaped as described herein but may have any shape that cooperates to provide engagement with an actuator for which it is desired to provide a tactile feel.

Although the support portion is preferably common to both arm pairs such as for the rectangular embodiment described herein, each arm pair may have its own separate support portion which may be secured at different locations provided that the result is two substantially transverse arm pairs that have respective free-ends that engage the actuator and provide a tactile feel to the operation thereof by exerting respective forces thereagainst whose combination initially increases and then decreases as the actuator is moved from a first to a second position.

What is claimed is:

1. A switch assembly including an actuator moveable between a first and a second position and a biasing member adapted to provide the actuator with a tactile feel;

said biasing member having a support portion secured against movement relative the actuator, a first pair of apposed resilient cantilever arms extending towards each other from opposite sides of the support portion to respective spaced-apart free-ends engaged with the actuator, a second pair of apposed resilient cantilever arms extending from opposite sides of the support portion substantially transversely to the first pair of arms to respective spaced-apart free-ends engaged with the actuator, said first pair of arms adapted to impose a first biasing force against the actuator that initially increasingly and thence decreasingly apposes movement thereof between the first and second positions, and said second pair of arms adapted to impose a second biasing force against the actuator that is different from the first biasing force and that initially increasingly and thence decreasingly apposes movement of the actuator between the first and second positions and that in combination with the first biasing force provides a tactile feel to movement of the actuator between the first and second positions.

2. The assembly of claim 1 wherein the first pair of arms respectively have a prescribed cantilever length between the support portion and the respective free-ends thereof that is different than the cantilever length between the support portion and the respective free-ends thereof of the second pair of arms.

3. The assembly of claim 1 wherein the support portion and the first and second pair of arms have substantially the same thickness.

4. The assembly of claim 1 wherein at least one of the first and second pair of arms has a substantially triangular shape with a base thereof adjacent the support portion.

5. The assembly of claim 1 wherein the support portion is oriented substantially orthogonal to the actuator defining a neutral bending axis in a plane therethrough and the first and second positions are located such that the free-ends of the first and second pair of arms do not pass the neutral axis during movement of the actuator between the first and the second position.

6. A switch assembly including an actuator moveable between a first and second position and a biasing member adapted to provide the actuator with a tactile feel;

said biasing member having a support portion secured against movement relative the actuator defining a neutral bending axis in a plane therethrough that is substantially orthogonal to the actuator, a first pair of resilient cantilever arms extending towards each other from opposite sides of the support portion for a prescribed cantilever length to respective spaced-apart free-ends engaged with the actuator, a second pair of apposed resilient cantilever arms extending towards each other from opposite sides of the support portion substantially transversely to the first pair of arms for a cantilever length to respective free-ends engaged with the actuator that is than the different cantilever length of the first pair of arms, said first and second pair of arms adapted such that their respective free-ends do not pass the neutral bending axis during movement of the actuator between the first and second positions whereby said first pair of arms imposes a first biasing force against the actuator that initially increasingly and thence decreasingly apposes movement thereof between the first and second positions and the second pair of arms imposes a second biasing force against the actuator that is different than the first biasing force and that initially increasingly and thence decreasingly apposes movement thereof between the first and second positions and that in combination with the first biasing force is operative to provide a tactile feel to movement of the actuator between the first and second positions.

7. The assembly of claim 6 wherein at least one of the first and second pair of arms has a substantially triangular shape with a base thereof adjacent the support portion.

8. The assembly of claim 7 wherein both the first and second pair of arms have a substantially triangular shape with a base thereof adjacent the support portion.

9. The assembly of claims 1 or 6 wherein the actuator operates an electrical switch.

10. The assembly of claims 1 or 6 wherein the actuator operates a fluid control switch.

* * * * *